United States Patent [19]

Kamiya

[11] Patent Number: 5,030,021

[45] Date of Patent: Jul. 9, 1991

[54] MULTI-COLUMN DOT PRINTING DEVICE

[75] Inventor: Ryuji Kamiya, Mishima, Japan

[73] Assignee: Tokyo Electric Co., Ltd., Tokyo, Japan

[21] Appl. No.: 464,656

[22] Filed: Jan. 11, 1990

Related U.S. Application Data

[63] Continuation of Ser. No. 170,723, Mar. 21, 1988, abandoned.

[30] Foreign Application Priority Data

Mar. 26, 1987 [JP] Japan ..... 62-45428[U]

[51] Int. Cl.[5] ..... B41J 2/255; B41J 2/51

[52] U.S. Cl. ..... 400/124; 400/121

[58] Field of Search ..... 400/120, 121, 124, 126; 101/93.05

[56] References Cited

U.S. PATENT DOCUMENTS

| | | | |
|---|---|---|---|
| 4,010,835 | 3/1977 | Martin | 400/124 |
| 4,079,824 | 3/1978 | Ku | 400/124 |

FOREIGN PATENT DOCUMENTS

| | | | |
|---|---|---|---|
| 54-108643 | 8/1979 | Japan | 400/120 |
| 107485 | 8/1980 | Japan | 400/121 |
| 57-29966 | 2/1982 | Japan | 400/124 |
| 59-34507 | 8/1984 | Japan | 400/124 |
| 4069 | 1/1985 | Japan | 400/303 |
| 154080 | 8/1985 | Japan | 400/121 |

OTHER PUBLICATIONS

*IBM Tech. Disc. Bulletin,* vol. 29, No. 3, Aug. 1986, pp. 1304–1305.

*Primary Examiner*—David A. Wiecking

*Attorney, Agent, or Firm*—Frishauf, Holtz, Goodman & Woodward

[57] ABSTRACT

A dot printing device comprises a printing head including a plurality of needle lines each formed of a plurality of printing needles arranged at a predetermined pitch in a vertical direction, a control circuit for driving the needle lines, and a moving mechanism for moving said printing head in a horizontal direction, thereby allowing the printing head to perform a printing operation. In the dot printing device, the plurality of needle lines are first, second and third needle lines, each printing needle of the second needle line being positioned at an equal height to a corresponding needle of the first needle line in the vertical direction, and each printing needle of the third needle line being positioned at a different height from a corresponding printing needle of the first needle line in the vertical direction by a distance which is half of the predetermined pitch. The control circuit includes a section for selectively setting one of a high-speed printing mode and a high-quality printing mode and driving the first and second needle lines in the high-speed printing mode and the first and third needle lines in the high-quality printing mode. The moving mechanism includes a section for moving the printing head in the high-speed and high-quality printing modes.

7 Claims, 5 Drawing Sheets

MULTI-COLUMN DOT PRINTING DEVICE

This application is a continuation of application Ser. No. 07/170,723, filed Mar. 21, 1988, now abandoned.

BACKGROUND OF THE INVENTION

1. Field of the Invention

The present invention relates to a printing device and, in particular, to a dot printing device for marking dots, in the form of characters, on a printing paper sheet by selectively using printing needles.

2. Description of the Related Art

Conventionally, there is known a dot printing device which is equipped with a printing head having a plurality of printing needles arranged in a vertical direction as a needle line and performs a printing operation by electromagnetically driving the needle line while moving the printing head in a horizontal direction. The dot printing device has been used as an output terminal of, for example, a computer and a measuring instrument. Various functions and performances have been required on dot printers in accordance with their manner of use and the kind of apparatus and devices to be connected. A further improvement is expected regarding the printing speed, printing quality, and so on.

A high-speed printing operation can be implemented by increasing the travel speed of, for example, the printing head. In this case, the driving cycle of the printing needle is made short according to an increase in the travel speed of the printing head. In order to determine the driving cycle, however, it is necessary to take the response characteristic of the printing needle and the heat-radiation capacity of the printing head into an account. If these factors are disregarded, there is a possibility that the printing needles will fail to mark dots and that the printing head will be overheated. When the driving cycle of the printing needle is shortened to a period limited by the response characteristic of the printing needle and the heat-radiation capacity of the printing head, it is difficult to further increase the travel speed of the printing head.

A technique is known which allows the travel speed of a printing head to be increased even if the driving cycle of the printing needle is set to that period. In this technique, a plurality of printing needles are arranged as two needle lines in a vertical direction perpendicular to the direction of movement of the printing head such that each printing needle of one needle line is positioned at the same height as a corresponding needle of the other needle line in the vertical direction. When the printing head is used to print characters by one line, the number of drives of each needle line is reduced to one half its number in the case where a printing head having a single needle line is used. It is thus possible to double the travel speed of the printing head without changing the drive cycle of the needle line.

The printing quality depends upon, for example, the density of dots to be marked with the printing needle. The higher the density, the clearer the characters. In order to reduce the pitch of dots in a vertical direction, a printing head has been suggested which has a plurality of printing needles arranged as two needle lines in the vertical direction with each printing needle of one needle line positioned higher in the vertical direction than a corresponding one of the other needle line. In the printing operation using the printing head, the drive timing of the two needle lines is so controlled that the dots marked by the printing needles of one needle line can be located in the spaces between the dots marked by the printing needles of the other needle line. The pitch of the dots in a horizontal direction can be reduced by lowering, for example, the travel speed of the printing head without changing the driving cycle of the needle line.

It is desirable that an inexpensive dot printer can perform both of a high-speed printing and a high-quality printing. When the techniques mentioned above are used to improve the printing speed and printing quality, the printing head and control mechanism may become complex and bulkier. The whole size of, for example, the printing head is principally determined by the size of a heat sink for dissipating heat which is involved when the printing needle is driven. Even if the number of printing needles is slightly increased, the heat sink becomes considerably bulkier. It is, therefore, difficult to implement the aforementioned dot printer at low costs. In view of the aforementioned situation, many users have to select either one of a high-speed printing type and high-quality printing type from among dot printers in accordance with the necessity.

SUMMARY OF THE INVENTION

It is accordingly an object of the present invention to provide a dot printing device which is capable of performing a high-speed and high-quality printing operation without increasing the size of a printing head.

The object can be achieved by a dot printing device which comprises a printing head including first, second and third needle lines each formed of a plurality of printing needles arranged at a predetermined pitch in a first direction, each printing needle of the second needle line being positioned at a substantially equal height to a corresponding printing needle of the first needle line in a third direction which is perpendicular to a second direction different from the first direction, and each printing needle of the third needle line being positioned at a different height from a corresponding printing needle of the first needle line by a distance smaller than the predetermined pitch in the first direction; a control circuit for selectively setting one of a high-speed printing mode and a high-quality printing mode and driving the first and second needle lines in the high-speed printing mode and the first and third needle lines in a high-quality printing mode; and a moving mechanism for moving the printing head in the second direction in the high-speed and high-quality print modes, thereby allowing said printing head to perform a printing operation.

In the dot printing device of the present invention, the first and second needle lines are in a positional relationship suitable for high-speed printing and the first and third needle lines are in a positional relationship suitable for high-quality printing. The control circuit selectively sets a high-speed printing mode or a high-quality printing mode. The control circuit enables the first and second needle lines in the high-speed printing mode and enables the first and third needle lines in a high-quality printing mode. In this way, it is possible to perform a printing operation both in the high-speed printing mode and in the high-quality printing mode. Since the first needle line is used not only in the high-speed printing mode but also in the high-quality printing mode there is no need to provide more than three printing needle lines in a printing head of a printer which will perform both high-speed printing and high-quality printing. That is, the size of the printing head can still be made in compact form. Therefore, the dot printer can be fabricated at a lower cost than the conventional case.

DETAILED DESCRIPTION OF THE PREFERRED EMBODIMENTS

A dot printing device according to one embodiment of the present invention will be explained below by referring to FIGS. 1 to 6B.

Figure 1:
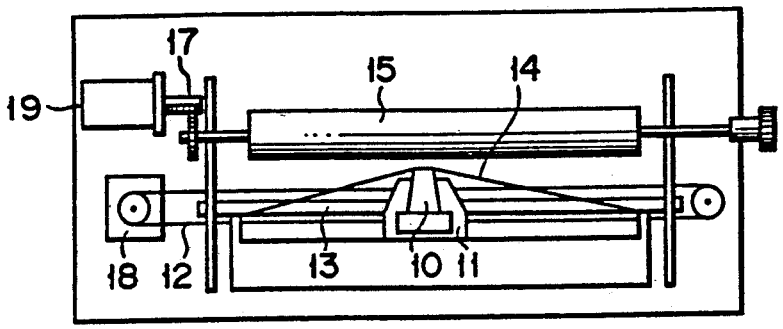
FIG. 1 is a schematic view showing a printing mechanism of a dot printing device according to an embodiment of the present invention.

FIG. 1 schematically shows a printing mechanism for a dot printing device. The printing mechanism includes printing head 10, carrier 11, carrier drive belt 12, carrier shaft 13, ink ribbon 14, platen 15, gearing 17, carrier motor 18 and feed motor 19. Printing head 10 is fixedly mounted on carrier 11 which is movably supported by carrier shaft 13 extending in a horizontal direction. Carrier motor 18 is coupled to carrier 11 through carrier drive belt 12 to reciprocate carrier 11 along carrier shaft 13. Ink ribbon 14 is located between the front end of printing head 10 and platen 15 extending in parallel with carrier shaft 13, and extends in the horizontal direction. A printing paper sheet is inserted between ink ribbon 14 and platen 15. Feed motor 19 is coupled through gearing 17 to platen 15 to feed the printing paper sheet in a vertical direction with the rotation of platen 15. Printing head 10 is moved in the horizontal direction together with carrier 11 to print characters on the paper sheet in ink penetrated in ink ribbon 14.

The arrangement of printing head 10 will be explained below in detail.

Figure 2:
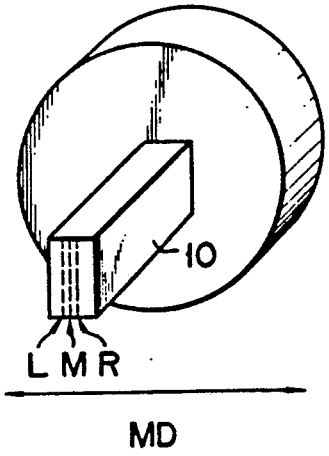
FIG. 2 is a perspective view showing a printing head of FIG. 1.
Figure 3:
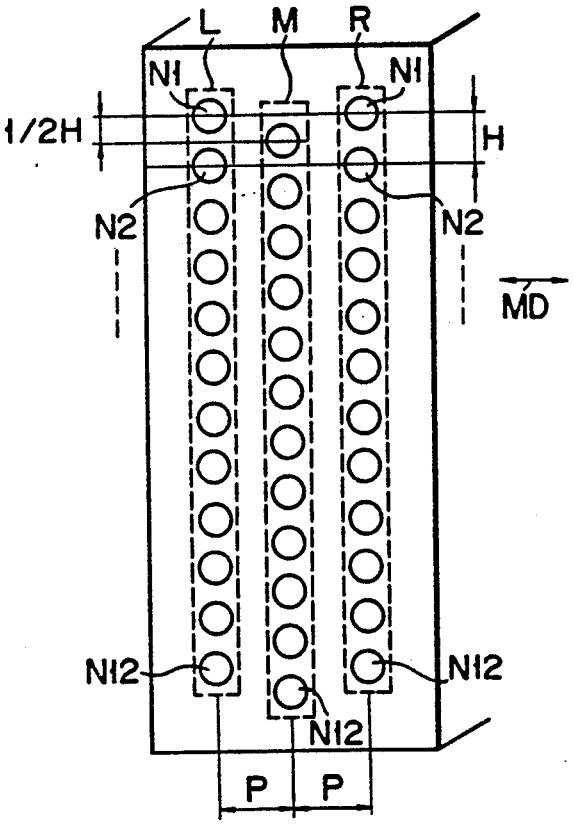
FIG. 3 shows an array of printing needles at the front end of the printing head in FIG. 2.

FIG. 2 is a perspective view of printing head 10 and FIG. 3 shows a front end of printing head 10. Printing head 10 has three needle lines L, M and R arranged in parallel with each other at an equal pitch P. Each of needle lines L, M and R has 12 printing needles N1 to N12 arranged at a pitch H in a first direction. Each of printing needles N1 to N12 of the needle line L is positioned at an equal height to a corresponding one of printing needles N1 to N12 of needle line R in a third direction perpendicular to a second direction different from the first direction. On the other hand, each of the printing needles N1 to N12 of the needle line L is positioned at a different height from a corresponding one of printing needles N1 to N12 of needle line M by one half pitch, i.e., ½H in the first direction. Printing head 10 is so mounted on carrier 11 that the second direction coincides with a direction of movement of printing head 10. In this connection it is to be noted that the first and third directions correspond to the vertical direction and the second direction corresponds to the horizontal direction.

Figure 4:
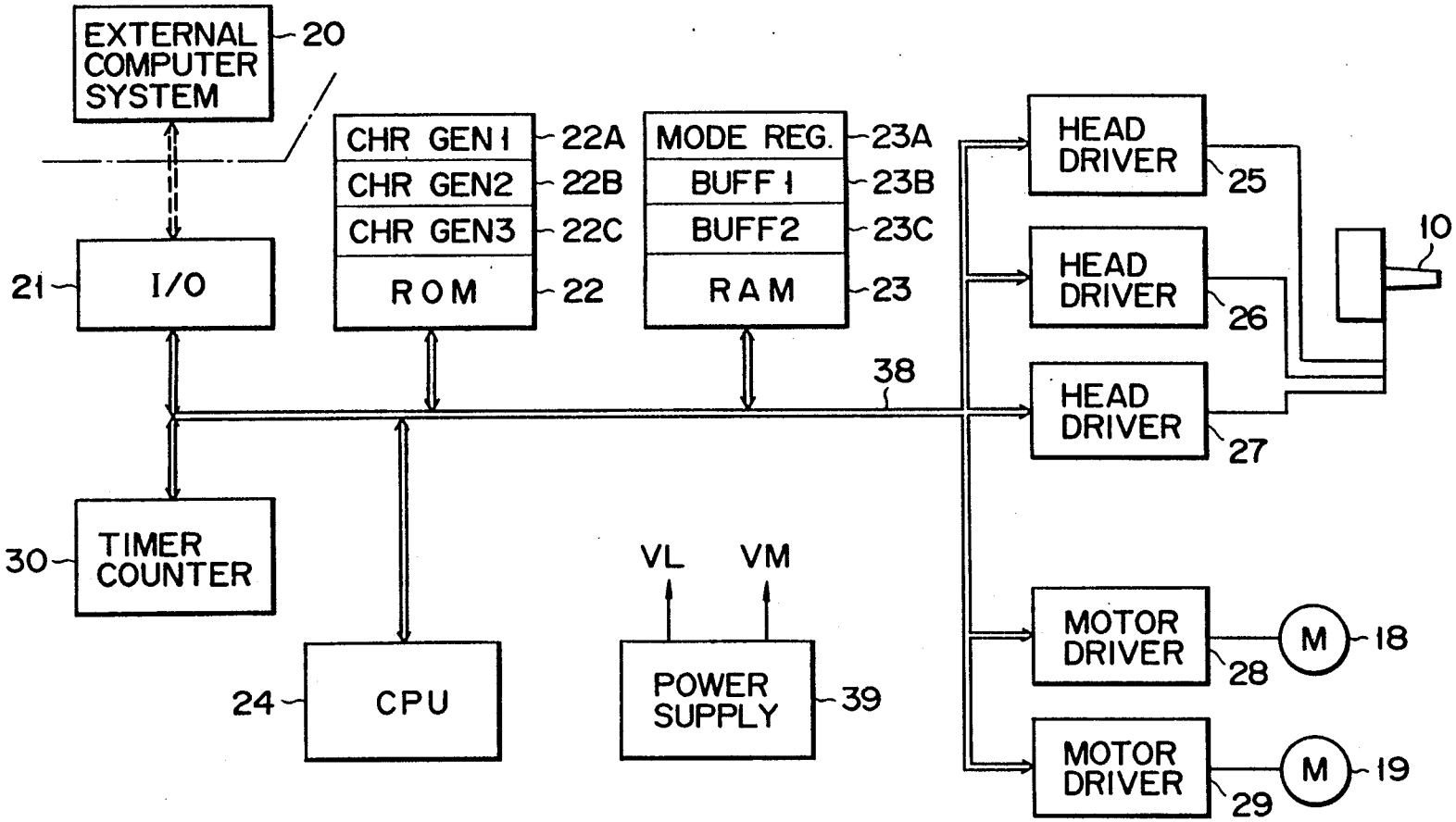
FIG. 4 is a schematic diagram showing a control circuit for the printing mechanism of FIG. 1.

FIG. 4 shows a control circuit for the aforementioned printing mechanism. The control circuit includes I/0 interface 21, ROM22, RAM23, CPU24, head drivers 25, 26 and 27, carrier motor driver 28, feed motor driver 29 and timer counter unit 30. These circuit elements are connected to each other via bus line 38. Power supply circuit 39 as shown in FIG. 2 separately generates a power source voltage VL for the circuit elements in the control circuit and a power source voltage VM for printing head 10 and motors 18 and 19. I/0 interface 21 is connected to, for example, external computer system 20 for receiving printing data, such as character code and control code. A control program of CPU24 is stored in ROM22. ROM22 includes memory areas which each store p plurality of dot patterns as a 12×12 dot matrix and serves as first, second and third character generators 22A, 22B and 22C, respectively. Each dot pattern stored in first character generator 22 represents one character, and each dot pattern stored in second character generator 22B represents one character in cooperation with a corresponding dot pattern stored in character generator 22C. Each dot pattern stored in character generators 22A, 22B and 22C can be read out in the form of twelve column dot patterns which represent the respective column portions of a corresponding character. CPU24 performs a printing control processing by sequentially reading out and executing instructions included in the control program. RAM23 includes a memory area serving as mode register 23A for storing mode data indicating one of a high-speed printing mode and a high-quality printing mode, a memory area serving as input buffer 23B for storing printing data supplied from computer system 20 and a memory area which stores column dot pattern read out from ROM22 and serves as output buffer 23C. Head drivers 25, 26 and 27 are connected to drive the respective needle lines L, M and R in accordance with a column dot pattern supplied from output buffer 23C. Timer counter unit 30 includes a position timer for detecting the position of printing head 10 in terms of the time and a dot counter for designating two sequential column dot patterns in output buffer 23C. Carrier motor driver 28 and feed motor driver 29 rotate carrier 18 and feed motor 19, respectively to change a printing position determined by a relative positional relation between the printing paper sheet and printing head 10.

The operation of the control circuit will be explained below with reference to FIGS. 5A to 5C.

Figure 5A:
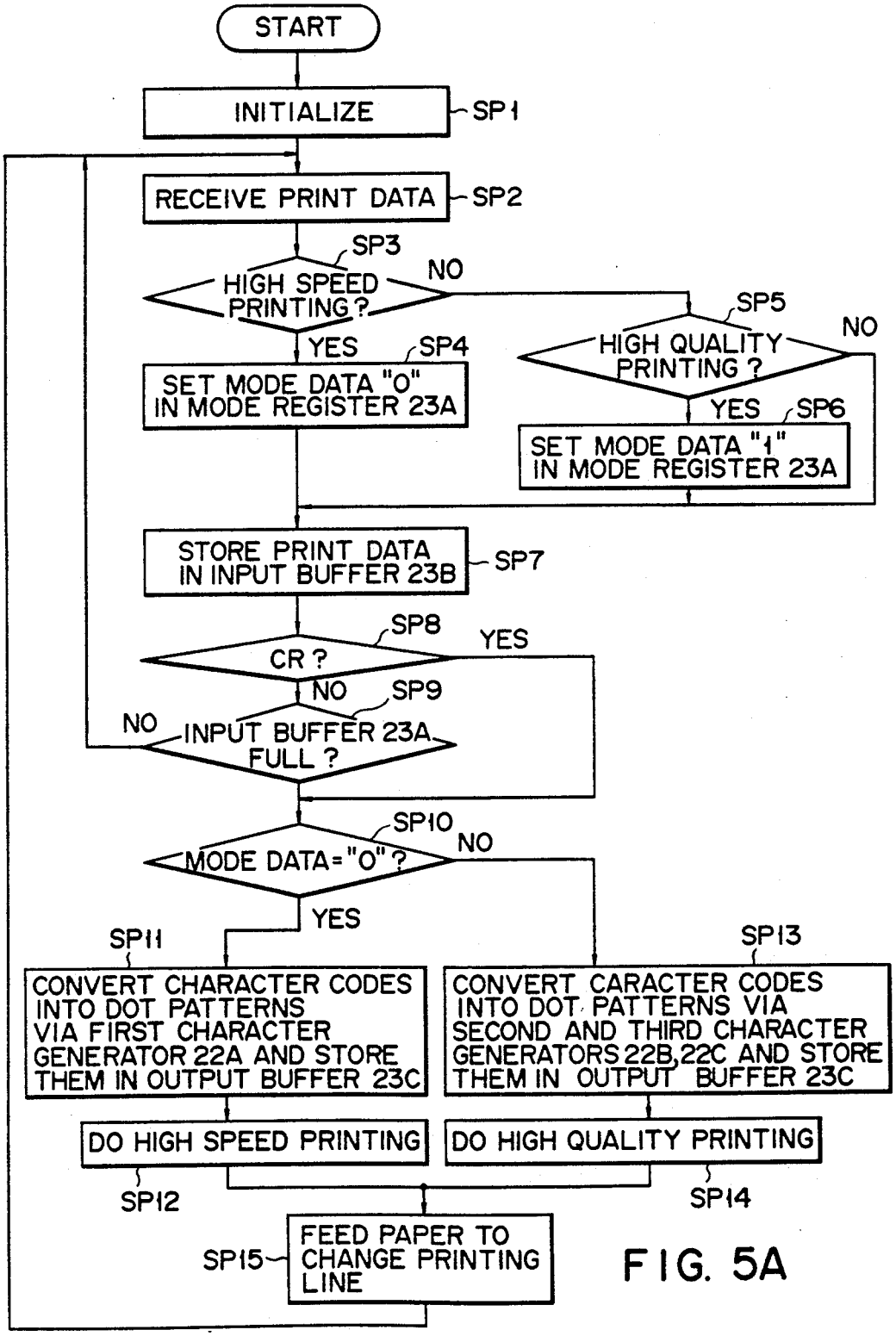
FIGS. 5A to 5C show flowcharts used for explaining the operation of the control circuit of FIG. 4.
Figure 5B:
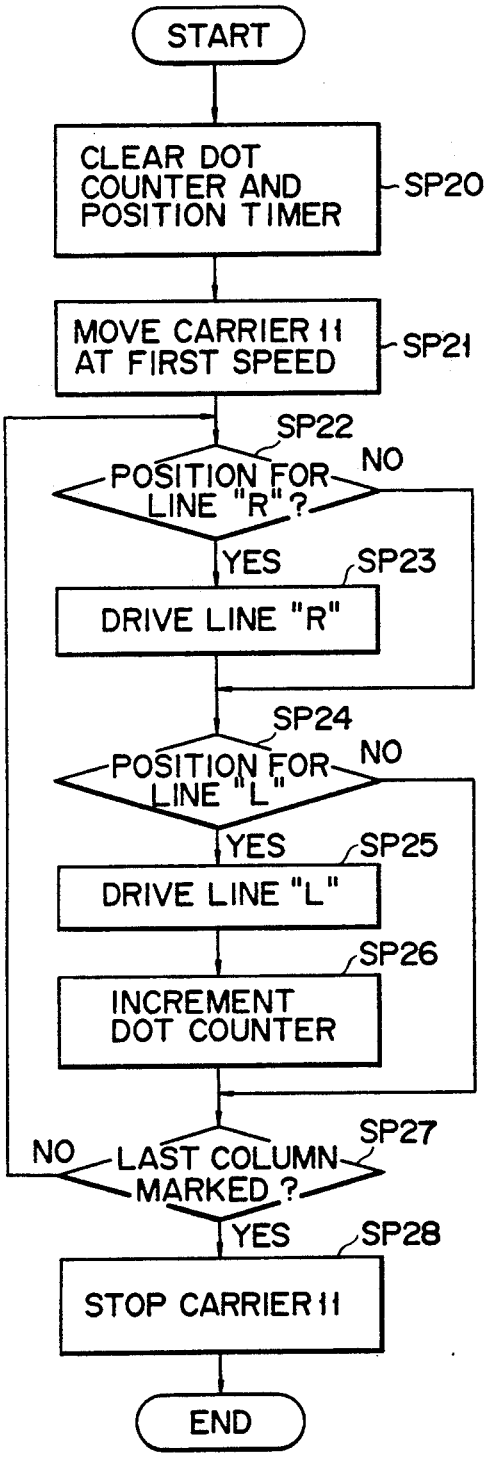
Figure 5C:
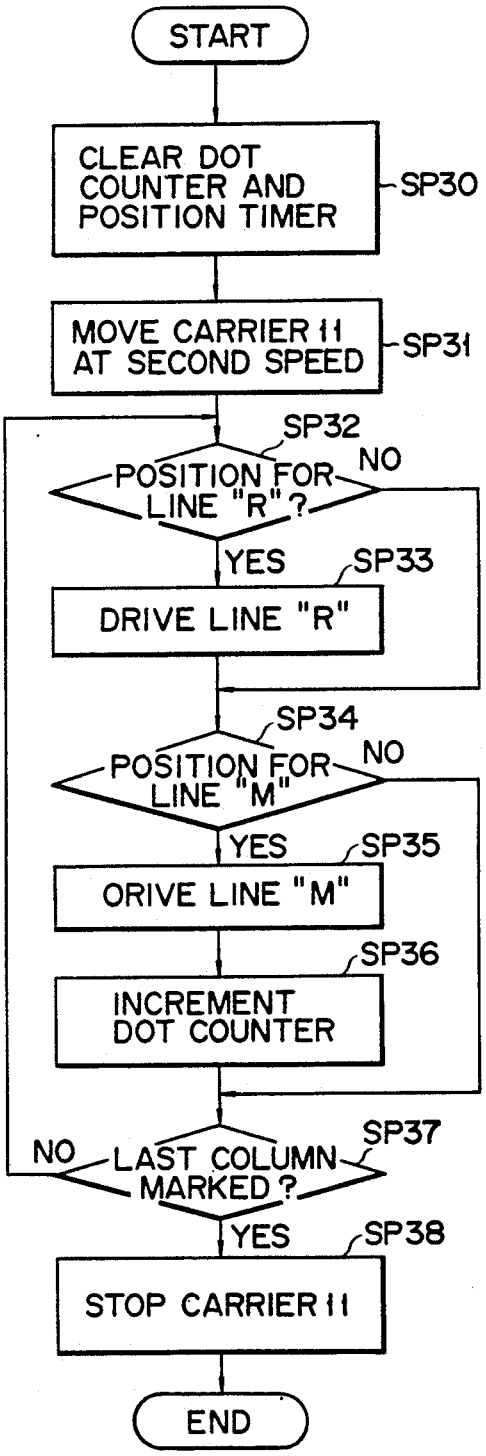

FIGS. 5A to 5C show a flow of a printing control process as performed by CPU24. When a flow as shown in FIG. 5A is started, CPU24 executes an initialization process at step SP1. In the initialization process, mode data "0" representing the high-speed printing mode is preset to mode register 23A, and drive control signals are supplied to carrier motor driver 28 and feed motor driver 29. Carrier motor driver 28 and feed motor driver 29 rotate carrier 18 and feed motor 19, respectively, until printing head 10 is set to an initial printing position. After printing head 10 is set to the initial printing position, printing data is received at step SP2. At step SP3, a check is made to see whether or not the printing data is a control code for instructing a high-speed printing. If the printing data is said control data, mode data "0" representing the high-speed printing mode is set to mode register 23A at step SP4, and then step SP7 is executed. If, on the other hand, the printing data is not said control data, check is made at step SP5 to see whether or not the printing data is a control code for instructing a high-quality printing. If the result of checking is YES, mode data "1" representing a high-quality printing mode is set to mode register 23A at step SP6, followed by the execution of step SP7. If the result of checking is NO, step SP7 is executed. At step SP7, printing data is stored in input buffer 23B. At step SP8, check is made to see whether or not the printing data is a control code for instructing a carrier returning. If the result of checking is YES, step SP10 is executed. If the result of checking is NO, check is made to see whether or not input buffer 23B is full. If input buffer 23B is full, step SP10 is performed. If, on the other hand, input buffer 23B is not full, control is returned back to step SP2 and the next printing data is received. At step SP10, check is made to see whether or not mode data stored in mode register 23A is "0" representing the high-speed mode. If mode data=0, character codes printing data stored in input buffer 23B are sequentially converted by first character generator 23A into corresponding dot patterns at step SP11. That is, each character code is read out from input buffer 23B, to select a corresponding one of dot patterns in first character generator 22A. The column dot patterns of a selected dot pattern are read out from first character generator 22A and sequentially stored in output buffer 3C. Then, a high-speed printing processing is performed at step SP12. If, on the other hand, mode data≠0 at step 10, character codes of the printing data stored in input buffer 23B are sequentially converted by second and third character generators 22B and 22C into dot patterns at step SP13. That is, each character code is read out from input buffer 23B so as to select a corresponding one of the dot patterns in second character generator 22B and a corresponding one of the dot patterns in third character generator 22C. The column dot patterns of selected two dot patterns are alternately read out from second and third character generators 22B and 22C and sequentially stored in output buffer 23C. At step SP14, a high-quality printing process is performed. After the completion of the processings at steps SP12 and SP14, the printing paper sheet is fed to the next printing line at step SP15 and printing data is received at SP2.

The high-speed printing process of step SP12 is performed in accordance with a flow of FIG. 5B. At the start of the flow, a dot counter and position timer are cleared at step 20 and carrier motor 18 slows up the travel speed of carrier 11 at step SP21 and is controlled to set carrier 11 to a first predetermined speed for a high-speed printing. After the speed of carrier 11 is set to the first predetermined speed, check is made to see whether or not printing head 10 is located in a position where dots should be marked with the needle line R. If the result of checking is NO, the operation of step SP24 is executed at step SP24. If, on the other hand, the result of checking is YES, the operations of steps SP23 and SP24 are performed. At step SP23, a preceding one of two column dot patterns designated by the dot counter is supplied from output buffer 23C to head driver 27 and head driver 27 drives the needle line R in accordance with the column dot pattern. At step SP24, check is made to see whether or not printing head 10 is located in a position where dots should be marked with the needle line L. If the result of checking is NO, step SP27 is executed. If the result of checking is YES, steps SP25, SP26 and SP27 are executed. At step SP25, a subsequent one of the two column dot patterns designated by the dot counter is supplied from output buffer 23C to head driver 25 and head driver 25 drives the needle line L in accordance with the column dot pattern. At step SP26, the dot counter is incremented by "1" step SP27 check is made to see whether or not printing has been completed with one printing line. If the result of checking is NO, step SP22 is executed again. If, on the other hand, the result of checking is YES, motor driver 18 is controlled so that carrier 11 is stopped at step SP28. The high-speed printing processing is completed subsequent to the stopping of carrier 11.

The high-quality printing process of step SP14 is performed in accordance with a flow of FIG. 5C. At the start of the flow, the dot counter and position timer are cleared at step SP30 and then carrier motor 18 slows up the travel speed of carrier 11 at step SP31 and thus is controlled to set the travel speed at a second predetermined speed for a high-quality printing which is lower than the first predetermined speed. After the travel speed of carrier 11 has been set to the second predetermined speed, check is made at step SP32 to see whether or not printing head 10 is located in a position where dots should be marked with the needle line R. If the result of checking is NO, step SP34 is executed. If, on the other hand, the result of checking is YES, steps SP33 and SP34 are executed. At step SP33, a preceding one of two column dot patterns designated by the dot counter is supplied from output buffer 23C to head driver 27 which in turn drives the needle line R in accordance with the column dot pattern. At step SP34, check is made to see whether or not printing head 10 is located in a position where dots should be marked with needle line M. If the result of checking is NO, step SP37 is executed. If, on the other hand, the result of checking is YES, steps SP35, SP36 and SP37 are executed. At step SP35, a subsequent one of the two column dot patterns designated by the dot counter is supplied from output buffer 23C to head driver 26 and head driver 26 drives the needle line M in accordance with the column dot pattern. At step SP36, the dot counter is incremented by "1". At step SP37, check is made as to whether or not printing has been completed with one printing line. If the result of checking is NO, step SP32 is again performed. If, on the other hand, the result of checking is YES, motor driver 18 is controlled to stop carrier 11 at step SP38. The high-quality printing process has been completed after carrier 11 has been stopped.

Figure 6A:
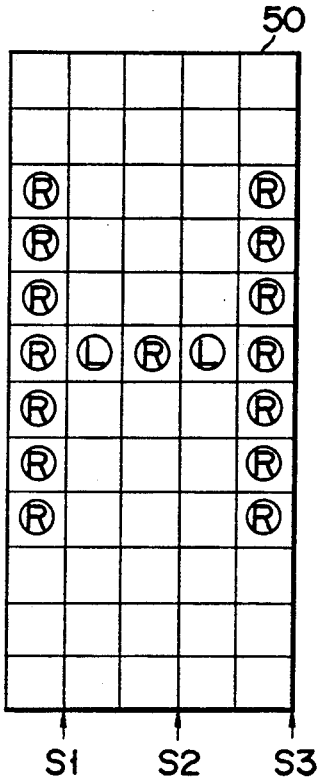
FIGS. 6A and 6B show a character "H" printed in the high-speed printing mode and high-quality printing mode, respectively.
Figure 6B:
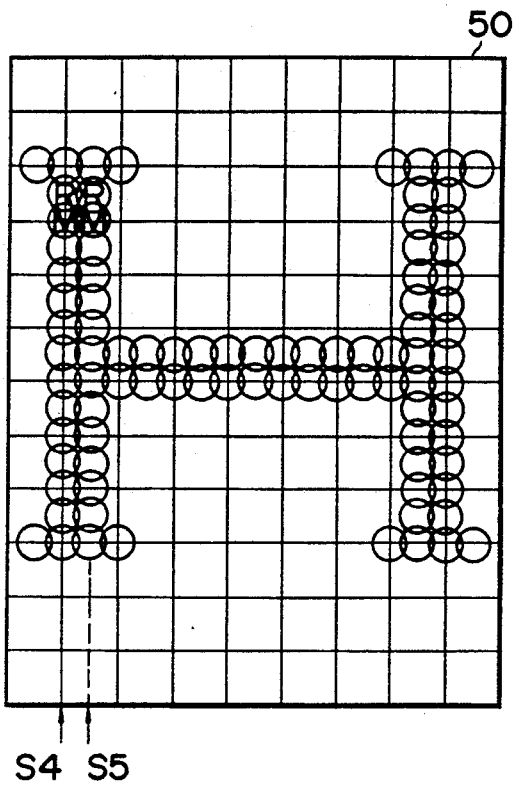

FIG. 6A shows a character "H" as printed in a high-speed mode and FIG. 6B shows a character "H" as printed in a high-quality printing mode. In the high-speed printing mode, printing is performed with the needle lines R and L, while printing is made at the first predetermined speed. The needle lines R and L are driven in such a timing that the center of printing head 10 or needle line M is located in a position, such as S1, S2 and S3 in FIG. 6A. In this case, two column dots are marked at a time on the paper sheet.

In the high-quality printing mode, printing is carried out with the needle lines R and M during the movement at the second predetermined speed slower than the first predetermined speed. The needle lines R and M are driven in such a timing that the needle lines R and M are each located in the position S4. In this case, in spaces between the dots marked with the needle line R, dots are marked with the needle line M to provide a line as shown in FIG. 6B. The needle lines R and M are also driven in such a timing that each is located in the position S5. Those dots marked in the position S5 are located adjacent to those dots marked in the position S4, so that a clear broad line is formed with these dots.

According to this embodiment, printing can be made by selecting the high-speed printing mode or a high-density printing mode. In this case, it is not necessary to prepare two different types of dot printing devices so as to perform a high quality printing and a high-speed printing. The practical utility of the printing device of the present invention is improved because either the high-speed printing mode or the high-quality printing mode can be selected by simply changing the mode data.

Further, since the diameter of each of needle lines R and M is so determined that the dots marked by needle line R are partially overlapped with the dots marked by needle line M and, at the same time, carrier 11 is controlled to move at a low speed in a high-quality printing mode, clear characters can be printed with no interstices left between their adjacent dots.

The dot printing device of the present invention can be implemented by simply modifying the specification of the existing conventional dot printers in connection with the contents of ROM as well as printing head 10 and associated peripheral circuits.

The present invention is not limited by the embodiment described above. The embodiment can be modified in a variety of ways without departing from the spirit and scope of the present invention.

For example, although in the aforementioned embodiment the dot printing device has been explained as being of an impact type having an ink ribbon, it may be applied to a non-impact thermal print type dot printer.

Figure 7:
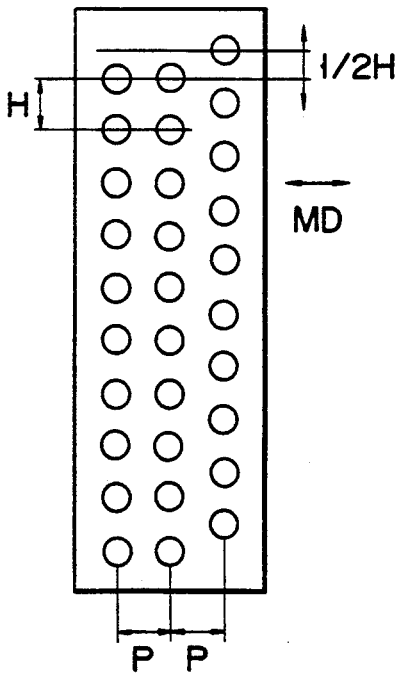
FIGS. 7 and 8 are modifications of the array of the printing needles as shown in FIG. 3.
Figure 8:
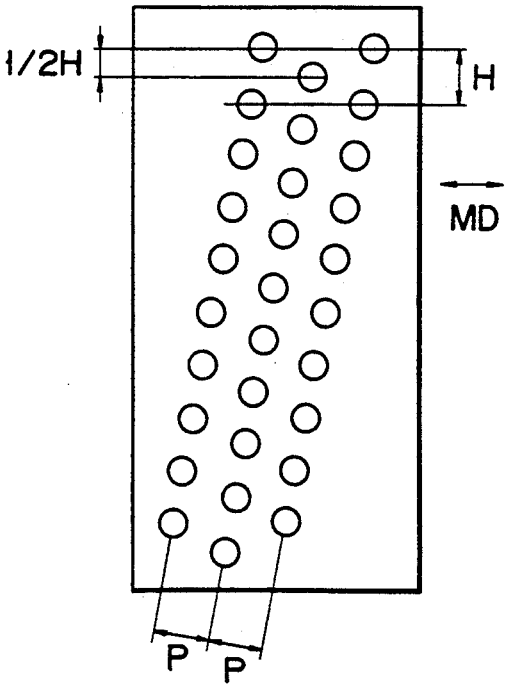

Printing head 10 may be modified as shown in FIG. 7 or FIG. 8.

Although, in the aforementioned embodiment, the mode data has been explained as being rewritten in accordance with the control code, if subsequent to selecting either the high-speed printing mode or the high-quality printing mode in units of the printing line there is no longer any need to make a further change in mode, a proper switch, such as a DIP switch, may be connected to I/0 interface 21 so that the output signal of the DIP switch can be detected through the initialization process with said output signal as mode data.

What is claimed is:

1. A dot printing device comprising:

a carrier;

moving means for moving said carrier in a printing direction;

a printing head including first, second and third column of printing needles arranged at a predetermined pitch, the needles of each column being substantially parallel with those of the other columns, each printing needle of said second column being positioned at substantially the same height as a corresponding printing needles of said first column, the printing needles of said third column being positioned in staggered fashion with respect to the printing needles of said first column, and said printing head being fixed to said carrier and immovable relative to said carrier such that each printing needle of said first column and the corresponding printing needle of said second column are aligned in said printing direction; and control means for selectively setting one of a high-speed printing mode and a high-quality printing mode, and said control means including means for driving said printing needles of said first and second columns while said carrier is moving in said high-speed printing mode and means for driving the printing needles of said first and third columns while said carrier is moving in said high-quality printing mode, without changing the positional relationship between said carrier and the needles of said first, second and third columns.

2. A dot printing device according to claim 1, wherein said moving means includes driving means for moving said carrier at a first speed in said high-speed printing mode and at a second speed in said high-quality printing mode, said second speed being lower than said first speed.

3. A dot printing device according to claim 1, wherein each printing needle of said third column is positioned at a different height from a corresponding printing needle of said first column by a distance which is approximately half of said predetermined pitch.

4. A dot printing device according to claim 1, wherein said control means includes mode selecting means connected to receive a control code, and including means for setting a predetermined one of said high-speed and high-quality printing modes, and for changing the predetermined printing mode to the other printing mode in response to the control code.

5. A dot printing device according to claim 1, wherein said control means includes mode selecting means connected to receive first and second control codes, for selecting said high-speed printing mode in response to the first control code and for selecting said high-quality printing mode in response to the second control code.

6. A dot printing device according to claim 5, wherein said mode selecting means includes mode data generating means responsive to each of the first and second control codes, for generating mode data indicative of a corresponding one of the high-speed and high-quality printing modes, and a mode register for storing mode data supplied from said mode data generating means.

7. A dot printing device according to claim 6, wherein said mode data generating means includes input means for receiving said first and second control codes together with character codes which designate characters to be printed by one printing operation.

* * * * *